United States Patent [19]

Elders et al.

[11] 4,065,738

[45] Dec. 27, 1977

[54] DEFLECTION COIL UNIT COMPRISING TOROIDALLY WOUND COILS FOR A COLOR TELEVISION DISPLAY TUBE

[75] Inventors: Marius J. A. Elders; Nicolaas G. Vink; Cornelis van Steen, all of Eindhoven, Netherlands

[73] Assignee: U.S. Philips Corporation, Briarcliff Manor, N.Y.

[21] Appl. No.: 701,310

[22] Filed: May 30, 1976

[30] Foreign Application Priority Data

July 9, 1975 Netherlands ..... 7508146

[51] Int. Cl.[2] ..... H01J 29/66

[52] U.S. Cl. ..... 335/213

[58] Field of Search ..... 29/602, 605, 607; 335/210, 213

[56] References Cited

U.S. PATENT DOCUMENTS

| | | | |
|---|---|---|---|
| 3,688,156 | 8/1972 | Utsonomiya et al. | 335/213 X |
| 3,895,329 | 7/1975 | Logan et al. | 335/213 X |

*Primary Examiner*—A. D. Pellinen

*Attorney, Agent, or Firm*—Frank R. Trifari; Henry I. Steckler

[57] ABSTRACT

A deflection coil unit for color television, comprising coils which are toroidally wound on a ring core having a flared inner surface. The parts of the coils which extends along the inner surface are situated in grooves having side walls whose plane is parallel to the axis of the ring core.

4 Claims, 4 Drawing Figures

Figure 1:
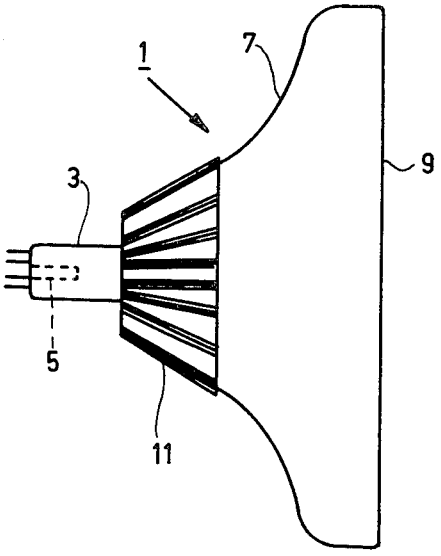

DEFLECTION COIL UNIT COMPRISING TOROIDALLY WOUND COILS FOR A COLOR TELEVISION DISPLAY TUBE

The invention relates to a deflection coil unit for a colour television display tube, comprising a neck portion, accommodating means for generating electron beams, and a flared portion which comprises a display screen at its widest end, the said deflection coil unit comprising a ferromagnetic ring core whose inner surface is adapted to the flared shape, and also two deflection coil systems for deflecting the electron beams in the horizontal and the vertical direction, respectively. At least one of the two deflection coil systems consisting of a number of individual, toroidally wound coils which are distributed along the circumference of the ring core.

A deflection coil unit of this kind is shown from U.S. Pat. No. 3,688,156. By a suitable choice of the number, the location and the numbers of turns of the toroidal coils for a given deflection direction, it is in principle possible to impart the desired geometry to the deflection field for the relevant direction. It is important that the turns of the coils are accurately fixed in the predetermined position. The said U.S. patent describes a number of steps intended for the fixation. These steps consist in the provision of separate, annular auxiliaries comprising projections in order to separate the coil from each other on the outer side of the ring core. It has been found, however, that the individual turns tend to be adjacently disposed, notably at the area where the coils bear against the flared inner surface, with the result that the coil locally becomes too wide. It has also been found that it may be attractive to wind the coils at least partly in a direction which substantially deviates from the axial direction, so that the designer is given an additional degree of freedom. This cannot be realized in a suitably reproducible manner in the known constructions.

The invention has for its object to provide a deflection coil unit where the designer has a very high degree of freedom as regards the choice of the shape and the situation of the toroidally wound coils, whilst the shape and the situation chosen are accurately fixed in a reproducible manner, the arrangement being such that the manufacturing costs are not substantially increased.

To this end, the deflection coil unit in accordance with the invention is characterized in that the part of at least some of the toroidally wound coils which extends along the inner surface of the ring core is situated substantially completely in a groove having two flat side walls, the plane of each of these two side walls being parallel to the axis of the ring core, the plane of at least one of the two side walls of at least one of the grooves not including the axis of the ring core. Because the plane of the side walls is parallel to the axis of the core, the grooves can be readily and inexpensively formed by moulding in a comparatively simple mould. This limitation has been found to be acceptable to the coil designer in practice.

If the two side walls do not include the axis and are mutually parallel, the relevant coil will be arranged at an angle with respect to the axial direction. If the side walls are not mutually parallel, the width of the groove and hence the width of the coil varies.

These possibilities make it comparatively easy for the designer to design a suitable deflection coil unit for any desired deflection field.

The invention will be described in detail hereinafter with reference to the drawing.

FIG. 1 diagrammatically shows a colour television display tube comprising a deflection coil unit in accordance with the invention.

Figure 2:
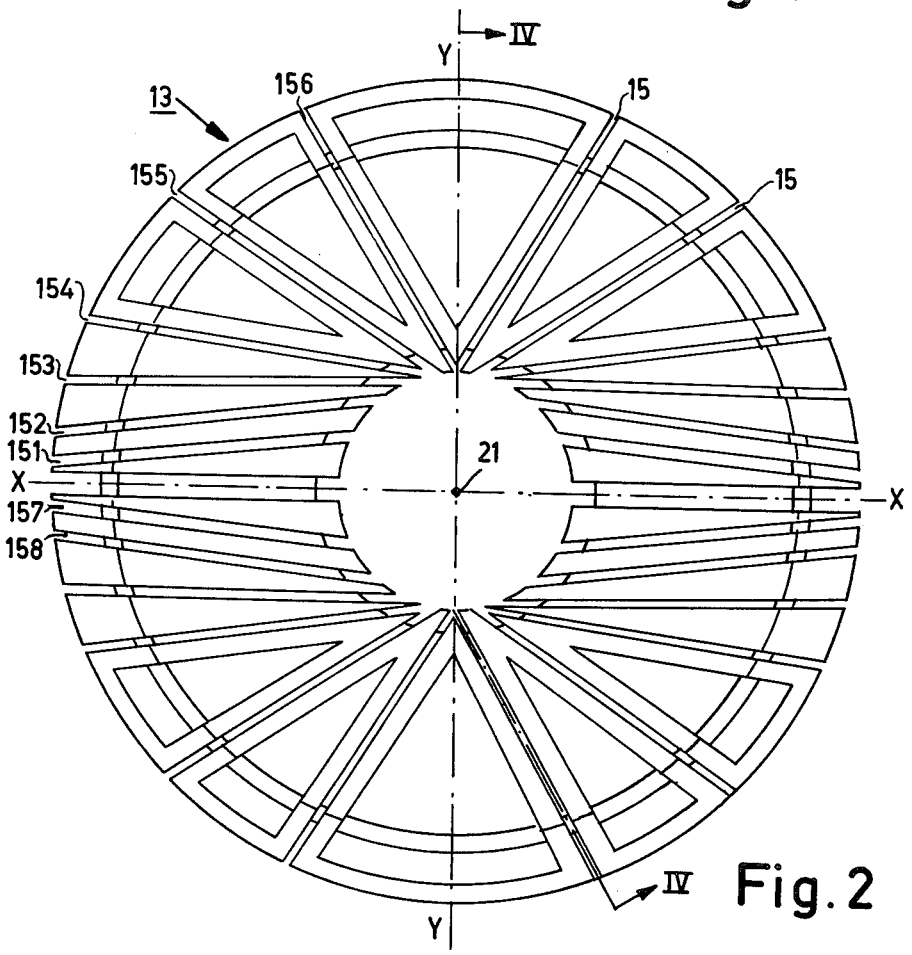
Figure 3:
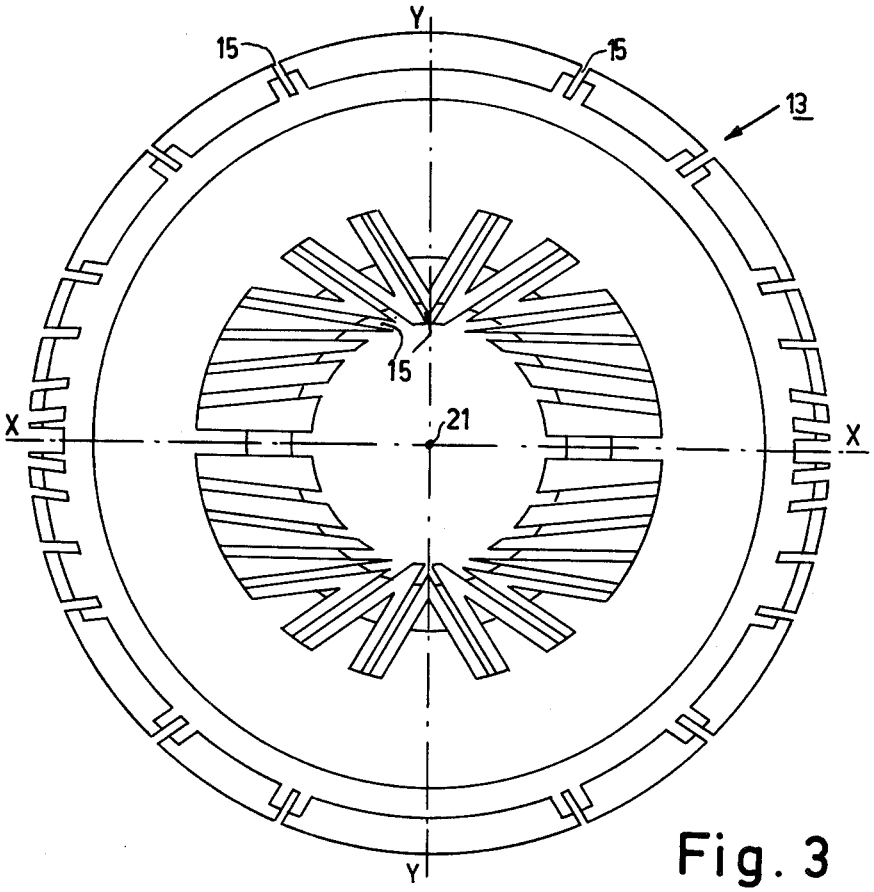
Figure 4:
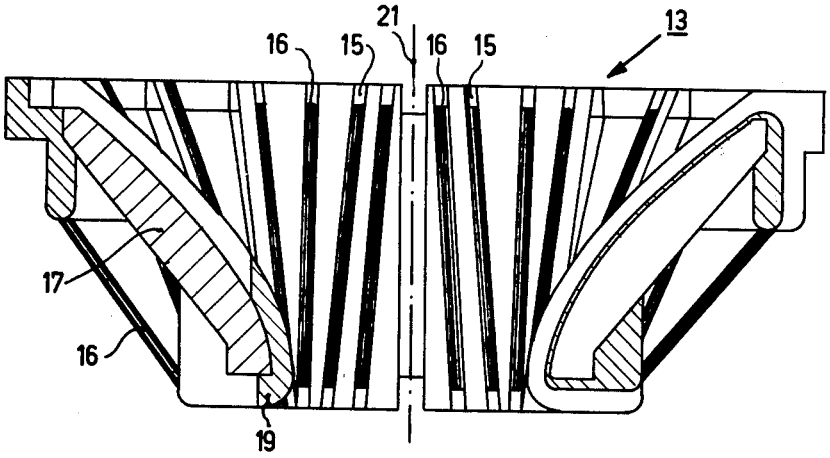

FIG. 2 is a front view of a ring core assembly comprising grooves, the said ring core assembly forming part of an embodiment of a deflection coil unit in accordance with the invention, FIG. 3 is a rear view of the same ring core assembly, and FIG. 4 is a longitudinal sectional view of a deflection coil unit including the ring core assembly shown in the FIGS. 2 and 3.

FIG. 1 diagrammatically shows a colour display tube 1, comprising a neck portion 3 which accommodates three adjacently arranged electron guns 5, only one of which is shown (broken lines). The display tube 1 comprises on its front side (at the right in FIG. 1) a flared portion 7, the foremost limitation of which is formed by a display screen 9. At the area where the neck portion 3 changes over into the flared portion 7, there is provided a deflection coil unit 11 comprising toroidally wound deflection coils for deflecting the electron beams generated by the electron guns 5 in horizontal and vertical directions. This deflection coil unit will be described in detail with reference to the FIGS. 2 to 4. Obviously, FIG. 1 is merely a diagrammatic representation. Components which are not of immediate importance for the invention, such as the convergence and corrections means, are not shown.

FIGS. 2 and 3 are a front view and a rear view, respectively, of a ring core assembly 13, comprising grooves 15 for a deflection coil unit 11. FIG. 4 is a sectional view taken along the line IV—IV in FIG. 2, toroidally wound coils 16 being accommodated in the grooves. On the outer side of the ring core assembly 13 the coils 16 are not accommodated in grooves, but bridge the distance between the front and the rear of the ring core assembly through the air. As is clearly shown in FIG. 4, the ring core assembly 13 consists of a ring core 17 of ferromagnetic material, preferably ferrite, which is encapsulated in a mould by a body 19 of synthetic material in which the grooves 15 are recessed. In order to increase the magnetic permeability, the synthetic material can possibly be mixed with granular or powder-like ferromagnetic material. If desired, the entire ring core assembly can also be made of ferrite, the grooves being recessed in the ferrite during pressing or being ground after pressing.

The side walls of the grooves 15 extend perpendicularly to the plane of the drawing of the FIGS. 2 and 3, i.e. their plane is parallel to the axis 21 of the ring core 17. As a result, the ring core assembly 13 can be readily removed from the mould after the formation of the grooves 15. Consequently, no complex and expensive mould comprising moving parts is required.

As is particularly clearly shown in FIG. 2, the planes of the walls of the grooves do not intersect the axis 21. The position of these planes can be varied by the designer in order to obtain the desired deflection field. If desired, the side walls of a groove can also enclose an angle with respect to each other.

In the embodiment shown, the coil system for the deflection of the electron beams in the horizontal direction (horizontal deflection coil system) as well as that for the deflection in the vertical direction (vertical deflection coil system) consists of a number of toroidally wound coils. It will be obvious that, if desired, one of the two systems can also be constructed in a different manner, for example, comprising saddle-shaped coils.

In the operating condition, the deflection coil unit 11 is arranged on the display tube 1 so that the line XX (see FIGS. 2 and 3) is horizontal. In a practical embodiment for a colour television display tube comprising three adjacently arranged electron guns, use is made of an embodiment of a deflection coil unit as shown in which the various toroidally wound coils are constructed so that the deflection coil unit is symmetrical with respect to the line XX and the line YY.

In the top left quadrant in FIG. 2 the following numbers of turns are accommodated in each of the grooves;

| groove number | number of turns |
|---|---|
| 151 | 28 |
| 152 | 32 |
| 153 | 30 |
| 154 | 24 |
| 155 | 19 |
| 156 | 13 |

In the other quadrants corresponding numbers of turns are provided in accordance with the above symmetry rules. The horizontal deflection coil is formed by parallel connection of the four series-connected coils situated immediately on both sides of the line XX and to the left of the line YY (i.e. the coils in the grooves 151, 152, 157 and 158) and the four series-connected corresponding coils to the right of the line YY. The vertical deflection coil consists of a series connection of the eight remaining coils above the line XX (i.e. the coils in the grooves 153 . . . 156 and the corresponding coils in the top right quadrant), and of the eight corresponding coils below the line XX.

In the described embodiment, the coils are wound of insulated copper wire having a thickness of 0.4 mm. The vertical deflection coil has a resistance of 6 Ohms, and the horizontal deflection coil has an inductance of 1.28 mH. Obviously, other coil impedances can be readily realised, without changing the deflection field, by interconnecting the coils in a different manner or by adaptation of the wire diameter and the numbers of turns. As a result, the deflection coil unit can be made suitable for different deflection circuits. Part of the toroidally wound coils, for which the accuracy requirements are less severe, can possibly be situated outside grooves 15. On the other hand, if desired, grooves or other fixing means can also be provided on the outer side of the ring core assembly 13.

What is claimed is:

1. A deflection coil unit for use with a colour television display tube, said tube comprising a neck portion, accommodating means for generating electron beams, and a flared portion which comprises a display screen at its widest end, said deflection coil unit comprising a ferromagnetic ring core whose inner surface is adapted to the flared shape, and also two deflection coil systems for deflecting the electron beams in the horizontal and the vertical direction respectively, at least one of the two deflection coil systems comprising a number of individual toroidally wound coils which are distributed along the circumference of the ring core, a part of at least some of the toroidally wound coils which extends along the inner surface of the ring core being situated substantially completely in a groove having two flat side walls, the plane of each of these two side walls being parallel to the axis of the ring core, the plane of at least one of the two side walls of at least one of the grooves not intersecting the axis of the ring core.

2. A deflection coil unit as claimed in claim 1, wherein the two side walls of each groove are parallel with respect to each other.

3. A deflection coil unit as claimed in claim 1 further comprising a body of synthetic material which encapsulates said core and comprises the grooves.

4. A deflection coil unit as claimed in claim 1, wherein the grooves are recessed in the ferromagnetic material of the ring core.

* * * * *